US009399805B2

(12) United States Patent
Munce

(10) Patent No.: US 9,399,805 B2
(45) Date of Patent: Jul. 26, 2016

(54) LEAD FREE DEZINCIFICATION ALLOY AND METHOD OF MAKING SAME

(71) Applicant: Mueller Industries, Inc., Memphis, TN (US)

(72) Inventor: Barry Munce, Lexington, MI (US)

(73) Assignee: Mueller Industries, Inc., Memphis, TN (US)

( * ) Notice: Subject to any disclaimer, the term of this patent is extended or adjusted under 35 U.S.C. 154(b) by 152 days.

(21) Appl. No.: 14/227,385

(22) Filed: Mar. 27, 2014

(65) Prior Publication Data

US 2014/0212325 A1 Jul. 31, 2014

Related U.S. Application Data

(62) Division of application No. 13/658,877, filed on Oct. 24, 2012, now Pat. No. 8,721,765.

(60) Provisional application No. 61/559,462, filed on Nov. 14, 2011.

(51) Int. Cl.

| | |
|---|---|
| ***C22C 9/04*** | (2006.01) |
| ***C22C 18/02*** | (2006.01) |
| ***C22C 9/00*** | (2006.01) |
| ***C22C 1/02*** | (2006.01) |
| ***C22F 1/08*** | (2006.01) |

(52) U.S. Cl.

CPC ... *C22C 9/00* (2013.01); *C22C 1/02* (2013.01); *C22C 9/04* (2013.01); *C22C 18/02* (2013.01); *C22F 1/08* (2013.01)

(58) Field of Classification Search

CPC ..... C22C 9/04; C22C 18/02

See application file for complete search history.

(56) References Cited

U.S. PATENT DOCUMENTS

| | | | | |
|---|---|---|---|---|
| 3,928,028 | A | 12/1975 | Yarwood | |
| 3,963,526 | A | 6/1976 | Lunn | |
| 4,101,317 | A | 7/1978 | Okano | |
| 4,822,562 | A * | 4/1989 | Miyafuji | C22C 9/04 420/472 |
| 5,306,329 | A | 4/1994 | Goodman, Jr. | |
| 6,599,378 | B1 * | 7/2003 | Hagiwara | C22C 9/04 148/434 |
| 8,273,192 | B2 * | 9/2012 | Xu | C22C 9/04 148/413 |
| 2002/0015657 | A1 * | 2/2002 | Dong | C22C 9/04 420/470 |
| 2002/0110478 | A1 | 8/2002 | Lawrence | |
| 2009/0311126 | A1 * | 12/2009 | Xu | C22C 9/04 420/471 |
| 2012/0237393 | A1 | 9/2012 | Murray et al. | |

OTHER PUBLICATIONS

AWWA Research Foundation, "Test Methods for Copper Alloys," DVGW-Technologiezentrum Wasser, From book: Internal Corrosion of water distribution systems, Copyright 1996 Second Edition, 1 page.

Davis, D.D. "A Note on the Dezincification of Brass and the Inhibiting Effect of Elemental Additions," Copper Development Association Inc., Jul. 1993, 5 pages.

The Hendrix Group, Materials & Corrosion Engineers "Corrosion of brass and brass alloys," Nov. 17, 2010, 9 pages.

Holm, Rolf et al. "Experiences With Components for Water Installations in Sweden," Proceedings of the International Symposium on Corrosion of Copper and Copper Alloys in Building, Japan Copper Development Association, Tokyo, 1982, pp. 230-238.

Mattsson, E. "Corrosion of Copper and Brass: Practical Experience in relation to Basic Data," Swedish Corrosion Institute, Br. Corros. J., 1980, vol. 15, Nov., 8 pages.

Nicholas, David "Dezincification of Brass in Potable Waters," Urban Water Research Association of Austrialia, Research Report No. 84, Aug. 1994, 175 pages.

Nielsen, Kate et al. "Comparative Study of Dezincification Tests,"The Danish Corrosion Centre, Br. Corros. J., 1973 vol. 8, May, 11 pages.

Sadayappan, M. et al. "Grain Refinement of Permanent Mold Cast Copper Base Alloys," Materials Technology Laboratory, Final Report MTL Report 2004-6 (TR-R), Apr. 2004, 124 pages.

Sandvig, Anne et al. "Performance and Metal Release of Non-Leaded Brass Meters, Components, and Fittings," AWWA Research Foundation, 2007, 144 pages.

Sarver, Emily et al. "Revisiting Brass Dezincification Performance Testing in Potable Water," Materials Selection and Design, Materials Performance 2011, NACE International, vol. 50, No. 4 and 5, 6 pages.

Seungman, Sohn et al. "The effects of tin and nickel on the corrosion behavior of 60Cu-40Zn alloys," Journal of Alloys and Compounds 335 (2002) pp. 281-289.

* cited by examiner

*Primary Examiner* — George Wyszomierski
*Assistant Examiner* — Tima M McGuthry Banks
(74) *Attorney, Agent, or Firm* — Harness, Dickey & Pierce, P.L.C.

(57) ABSTRACT

A brass alloy containing trace amounts of iron, manganese and aluminum is disclosed. Phosphorus is added to a zinc, copper melt and combined with the iron, manganese and aluminum to form intermetallics. Additional phosphorus is added so the melt contains between about 0.08 to 0.15% phosphorus. The alloy has tin in the range of 0.15% to 0.35%.

14 Claims, No Drawings

LEAD FREE DEZINCIFICATION ALLOY AND METHOD OF MAKING SAME

CROSS-REFERENCE TO RELATED APPLICATIONS

This application is a divisional of U.S. patent application Ser. No. 13/658,877, filed on Oct. 24, 2012. This application claims the benefit of U.S. Provisional Application No. 61/559,462, filed on Nov. 14, 2011. The entire disclosure of the above applications are incorporated herein by reference.

FIELD

The present disclosure relates to a brass alloy and, more particularly, to a lead-free dezincification resistant brass alloy used in water supply elements.

BACKGROUND

This section provides background information related to the present disclosure which is not necessarily prior art. With the advent of legislation in California (AB 1953), lead in brass components for potable water systems was mandated to contain less than 0.25% lead by weighted average starting Jan. 1, 2010. Since establishment of this legislation, additional states including Vermont, New Hampshire, Maryland and Louisiana have followed suit. National legislation has also recently been passed requiring all fifty states to supply lead free brass (less than 0.25% lead) for potable water applications by Jan. 1, 2014.

The removal of lead from brass significantly affects machinability of the materials. To overcome these problems, adjustments to the microstructure have been made. Unfortunately, the change in microstructure leads to increased dezincification. Dezincification is generally defined as a selective process by which zinc is removed from the alloy leaving behind a porous, copper-rich structure that has little mechanical strength.

Lead free brass further presents some significant challenges for the brass industry. Lead in brass acts as a chip breaker for the metal during machining. Additionally, the lead provides lubrication for the cutting tools. The absence or reduction of lead in brass for these functions reduces the machinability of brass. This, in turn, reduces productivity which results in driving up the cost of the finished parts. Existing Unified Numbering System 2000 series lead free brass alloys exhibit conventional machinability ratings in the range of 20% to 40% machinability compared to its leaded brass alloys counterparts.

Optionally, dezincification inhibition of the alpha phase in brass can be accomplished with certain corrosion inhibitors. Since duplex brasses contain a large amount of alpha phase, it is essential that an inhibiting agent be present in duplex brasses to assist with dezincification protection. Of the known inhibitors, arsenic is the most effective in improving dezincification resistance. There are a number of alloys that employ arsenic as an inhibitor. Although commonly used in Australia and Europe, there is a negative perception of arsenic as an inhibitor in potable water systems in the United States. Antimony is another effective inhibitor, but can result in processing issues such as cracking. These corrosion inhibitors however do not assist in reducing dezincification in the beta phase of duplex brasses. There is therefore a need for a brass for water systems which meets the new regulatory environment, is machinable, and does not suffer from dezincification.

SUMMARY

This section provides a general summary of the disclosure, and is not a comprehensive disclosure of its full scope or all of its features. According to the present teachings, a brass alloy is disclosed. The brass alloy has both alpha and beta phases. The brass has phosphorus content between 0.10 and 0.20% by weight, and tin between 0.15 and 0.35% by weight. The brass further has between 5 and 12% beta phase in a room temperature state.

In another embodiment, a method of producing brass is disclosed. The method includes extruding a brass alloy at a temperature less than about 1400° F. After extrusion, the material is held at about 450° C. for about four hours to transform a portion of the material's beta phase to alpha phase. The material has an average grain size less than 0.05 mm.

In another embodiment, a method of producing a brass alloy is disclosed. The alloy can contain trace amounts of iron, manganese or aluminum. Phosphorus is added to a zinc, copper melt and combines with the iron, manganese and aluminum to form intermetallics. Additional phosphorus is added so the melt contains between about 0.08 to 0.15% phosphorus in non-intermetallic phases.

In another embodiment, a low lead brass alloy is provided. The alloy comprises a total amount of tin in the range of 0.15% to 0.35% by weight, and between 0.08 and 0.15% by weight phosphorus. Further, the brass comprises at least one of iron, manganese or aluminum in the form of intermetallic metal phosphides.

Further areas of applicability will become apparent from the description provided herein. The description and specific examples in this summary are intended for purposes of illustration only and are not intended to limit the scope of the present disclosure.

DETAILED DESCRIPTION

Described herein is an alpha beta brass (muntz-metal) or duplex brass formed of copper and zinc. The brass material disclosed herein has between about 36-45% by weight zinc. The brass has both alpha and beta phases which can both suffer from dezincification. Dezincification of the alpha phase can be controlled by the use of inhibitory alloying materials. Unfortunately, the alloy materials do not affect dezincification in the beta phase. The machinability of brass is a function of grain size, phase proportions, and the properties of the microstructure. According to the teachings herein, to arrive at a duplex brass having both desirable dezincification properties and machinability, it is necessary to control both the chemistry and processing of the material.

According to the present teachings, the brass alloy has zinc, copper, and trace contaminants of iron, manganese, aluminum and combinations thereof. To allow for post formation machinability the alloy comprises about 5-12% beta phase. As described in detail below, phosphorus is added to the alloy to affect corrosion resistance and machinability. A first portion of the phosphorus combines with a portion of the trace contaminants to form intermetallics. A second portion of the phosphorus in interspersed within the alloy crystal structure to reduce dezincification. The intermetallics formed function as chip breakers for the brass during machining of the component. Additionally, tin can be present in the microstructure in the range of 0.15% to 0.35%. Beyond this level tin becomes less effective.

In addition to the formation of intermetallics, a third portion of the phosphorus combines with oxygen to reduce oxygen within the alloy. The second portion of phosphorus is between 0.8 and 0.15% phosphorus with the total amount of phosphorus in the melt being between 0.10 and 0.20%. Trace iron, aluminum and manganese will combine with phosphorus when the brass is melted to form the intermetallic metal phosphides. While these phosphides interfere with the ability to make this material dezincification resistant, at the same time the phosphides provide an intermetallic compound that acts as a chip breaker by interrupting the machine tool during machining.

To produce the brass component, zinc and copper are melted together to form a mixture. The amount of trace iron, manganese and aluminum in the zinc/copper mixture is determined using analytical methods. The first portion of phosphorus is added to the zinc/copper mixture to combine with the trace metals to form the intermetallics. After cooling, the brass alloy is heated to a temperature greater than 1100° F. and less than about 1400° F., and preferably greater than 1250° F. but less than 1350° F., where it is formed into a subassembly of a finished product. This can, for example, be an extrusion procedure. After formation, the intermediate material is maintained at a temperature of more than about 800° F. and less than 900° F., and preferably at 850° F. for about two to four hours. The post formation, elevated temperature profile converts beta brass to alpha brass. After cooling to room temperature, the subassembly component has a hardness Rb of about 50. To have a customer required hardness, the intermediate material can be reworked so the structure has an Rb of above about 69.

In the formation of the intermetallics, a first amount of phosphorus is added in a ratio of at least three parts phosphorus for every part iron detected. Additionally, at least one part phosphorus for every part manganese or aluminum detected can be added. Additional phosphorus is added to affect dezincification. It is envisioned the first, second and third portions of the phosphorus for intermetallic formation, dezincification, and oxygen removal can be added simultaneously.

The amount of zinc in the copper zinc matrix for brass determines whether the material will be single or duplex phase. As described, a certain amount of beta phase is needed to assist with both machinability and hot forming. Too much beta phase, however, will result in excessive dezincification and loss of component strength. As such, the brass according to the present teachings comprises about 5% to 12% beta phase to be most effective at improving machinability. During extrusion of the brass, the temperature of the material can be as high as 1400° F. and, preferably, above 1250° F. To facilitate the transformation from beta phase to alpha phase, heat generated during extrusion is used. The processed material is "slow cooled" in the extrusion pans from the extrusion temperature to room temperature for pickling. This "slow cooling" process eliminates the necessary reheating of the material for dissolution of the beta phase. The elimination of the reheating results in keeping the grain size as small as possible which improves the machinability and dezincification.

The brass disclosed is a lead free or low lead brass with improved machinability and dezincification resistance. A preferred embodiment uses phosphorus as the dezincification agent and be present in the range of 0.10% to 0.20%. Tin can be present to improve the phosphorus dezincification inhibiting effect and can be present in a range of about 0.15% to about 0.35%. Control of the amount of beta phase as a result of extrusion can be accomplished by "slow cooling" rather than heat treat to minimize the grain size. The grain size can be less than 0.05 mm, and preferably between about 0.025 and 0.01 mm. Metal phosphides can be intentionally formed from trace materials to assist with machinability, and beta phase preferably should be present at 5% to 12% to assist with machinability.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A brass alloy comprising:

zinc;

copper;

tin;

trace contaminants selected from the group consisting of iron, manganese, aluminum and combinations thereof; and phosphorous;

wherein a first portion of the phosphorous is present in combination with a portion of the trace contaminants in the form of intermetallic structures, wherein a second portion of the phosphorous comprises an amount sufficient to reduce dezincification of the brass alloy, and wherein a third portion of the phosphorous comprises an amount sufficient to combine with oxygen to reduce oxygen within the alloy.

2. The brass alloy according to claim 1, wherein the second portion of phosphorous is between 0.08 and 0.15 weight % phosphorous.

3. The brass alloy according to claim 1, wherein the total amount of phosphorous is between about 0.10 and about 0.20 weight %.

4. A brass alloy comprising:

zinc;

copper;

tin;

trace contaminants selected from the group consisting of iron, manganese, aluminum and combinations thereof; and phosphorous;

wherein a first portion of the phosphorous is present in combination with a portion of the trace contaminants in the form of intermetallic structures, and a second portion of the phosphorous comprises an amount sufficient to reduce dezincification of the brass alloy, wherein the alloy comprises about 5-12 weight % beta phase.

5. A brass alloy comprising:

a zinc and copper mixture;

trace amounts of iron, manganese and aluminum in the zinc and copper mixture;

a first amount of phosphorous in the zinc and copper mixture combined with a portion of the trace amounts of iron, manganese and aluminum, wherein the resulting combination has an intermetallic crystal structure; and a second amount of phosphorous between about 0.08 to about 0.15 weight % phosphorous in the zinc and copper mixture configured to inhibit dezincification of the zinc and copper mixture.

6. The brass alloy according to claim 5, wherein the zinc and copper mixture has an $R_b$ of about 50.

7. The brass alloy according to claim 5, wherein the structure has an $R_b$ greater than 69.

8. The brass alloy according to claim 5, wherein the first amount of phosphorous comprises at least three parts phosphorous for every part of the trace amount of iron in the zinc and copper mixture.

9. The brass alloy according to claim 5, wherein the first amount of phosphorous comprises at least one part phosphorous for every part of the manganese in the zinc and copper mixture.

10. The brass alloy according to claim 5, wherein the first amount of phosphorous comprises at least one part phosphorous for every part of the aluminum in the zinc and copper mixture.

11. The brass alloy according to claim 5, further comprising about 0.15 to about 0.35 weight % tin.

12. The brass alloy according to claim 5, wherein the first amount of phosphorous and the second amount of phosphorous are added to the zinc and copper mixture at the same time.

13. The brass alloy according the claim 5, wherein the zinc and copper mixture has an average crystal size of less than about 0.05 mm.

14. The brass alloy according the claim 5, wherein the zinc and copper mixture comprises 5-12 weight % beta phase.

* * * * *